US011567438B2

(12) United States Patent
Hasegawa

(10) Patent No.: US 11,567,438 B2
(45) Date of Patent: Jan. 31, 2023

(54) IMAGE FORMING APPARATUS

(71) Applicant: SHARP KABUSHIKI KAISHA, Sakai (JP)

(72) Inventor: Naoki Hasegawa, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/468,232

(22) Filed: Sep. 7, 2021

(65) Prior Publication Data

US 2022/0100136 A1 Mar. 31, 2022

(30) Foreign Application Priority Data

Sep. 25, 2020 (JP) ..... JP2020-161208

(51) Int. Cl.
*G03G 15/30* (2006.01)
*G03G 15/00* (2006.01)

(52) U.S. Cl.
CPC ..... *G03G 15/305* (2013.01); *G03G 15/5095* (2013.01); *G03G 15/602* (2013.01); *G03G 15/6597* (2013.01); *G03G 15/607* (2013.01); *G03G 2215/00042* (2013.01); *G03G 2215/00329* (2013.01); *G03G 2215/00333* (2013.01); *G03G 2215/00734* (2013.01)

(58) Field of Classification Search
CPC ..... G03G 15/305; G03G 15/5095; G03G 15/602; G03G 15/6597; G03G 15/607; G03G 2215/00042; G03G 2215/00329; G03G 2215/00333; G03G 2215/00734
See application file for complete search history.

(56) References Cited

U.S. PATENT DOCUMENTS 5,198,859 A * 3/1993 Soma ..... G03G 15/60 355/75

FOREIGN PATENT DOCUMENTS

JP H07-129027 A 5/1995
JP 2015114486 A * 6/2015
JP 2017065131 A * 4/2017 ..... B41J 11/0065

* cited by examiner

*Primary Examiner* — Ryan D Walsh
(74) *Attorney, Agent, or Firm* — ScienBiziP, P.C.

(57) ABSTRACT

An image forming apparatus includes: a transporter; an image former; a reflective optical sensor; an image density adjuster; and a controller. The image former includes: a photoreceptor; a charger; an exposer; a developer; a transferor; and a fuser. The reflective optical sensor is provided opposite to the photoreceptor across a conveyance path. During image density adjustment, the controller forms a predetermined patch toner image on the photoreceptor, irradiates the patch toner image with light, and control the image density adjuster to adjust image density based on reflected light from the patch toner image. During image forming, the controller causes the reflective optical sensor to emit light on timing that a predetermined leading edge area of the recording area passes, and decides based on reflected light therefrom whether a width in the main scanning direction of a recording medium is longer than a predetermined reference length.

5 Claims, 7 Drawing Sheets

IMAGE FORMING APPARATUS

CROSS-REFERENCE TO RELATED APPLICATION

The present application claims priority from Japanese Patent Application Number 2020-161208, the content to which is hereby incorporated by reference into this application.

BACKGROUND OF THE INVENTION

1. Field of the Invention

One aspect of the present disclosure relates to an image forming apparatus, and more particularly, to an image forming apparatus with a function to detect a printing paper sheet size.

2. Description of the Related Art

There has been known an image forming apparatus such as a multifunction machine, etc., having a function to detect a printing paper sheet size.

Conventionally, such an image forming apparatus is provided with a dedicated reacting sensor in a printing paper sheet conveyance path in order to detect whether the printing paper sheet size corresponds to a preset paper sheet size.

For example, as an invention directed to an image forming apparatus having such a reading sensor, an invention directed to an image forming apparatus is disclosed in which the length and width of a paper sheet in a conveyance direction are detected based on timing that the upper parts of a lever disposed near the middle of a conveyance path and a lever disposed near an end of the conveyance path detect traverse a photosensor when there is no sheet paper or based on whether they traverse the photosensor, and in a case in which the paper sheet is a small size paper sheet, a paper non-passage area of the fusing roller is cooled by a fan or a zone of the fusing roller around which the paper sheet passes is changed depending on a surface temperature of the fusing roller (see, for example, Japanese Patent Application Publication No. 7-129027)

SUMMARY OF THE INVENTION

Another invention directed to an image forming apparatus is also known in which a dedicated reading sensor is provided on a printing paper sheet conveyance path at a reference position at a predetermined distance (for example, 80.25 mm) from the center in a main scanning direction of the conveyance path, and the reading sensor determines whether the width in the main scanning direction of the paper sheet size is longer or shorter than a predetermined reference width.

This enables to know whether the printing paper sheet size is available for the length in the sub-scanning direction of the image to be printed, thereby preventing transfer contamination when a paper sheet that is smaller in size than the image to be printed is fed.

However, the image forming apparatus provided with such a dedicated reading sensor is costly because the dedicated reading sensor is used for detecting the size of the printing paper sheet.

One aspect of the present disclosure has been made in view of the above-described circumstances, and provides an image forming apparatus capable of reading a printing paper sheet size without using a dedicated reading sensor.

(1) One aspect of the present disclosure provides an image forming apparatus including a transporter that transports a recording medium through a conveyance path, an image former that forms an image on the recording medium based on image data, a reflective optical sensor for image density adjustment, an image density adjuster that adjusts image density based on detection result of the reflective optical sensor, and a controller. The image former includes a photoreceptor, a charger that charges the photoreceptor in contact with the photoreceptor, an exposer that forms an electrostatic latent image on the photoreceptor, a developer that supplies toner to the photoreceptor to form a toner image corresponding to the electrostatic latent image, a transferer that transfers the toner image to the recording medium, and a fuser that heat-fixes the toner image on the recording medium by a fusing roller. The reflective optical sensor is provided opposite to the photoreceptor across the conveyance path so as to irradiate with light a position away from a center line of the paper sheet conveyance path by a predetermined distance in a main scanning direction. During image density adjustment, the controller controls the charger, the exposer, and the developer to form a predetermined patch toner image on the photoreceptor, controls the reflective optical sensor to irradiate the patch toner image with light, and control the image density adjuster to adjust image density based on reflected light from the patch toner image. During image forming, the controller controls the transporter and the reflective optical sensor to cause the reflective optical sensor to emit light on timing that a predetermined leading edge area of the recording area passes, and decides based on reflected light therefrom whether a width in the main scanning direction of the recording medium is longer than a predetermined reference length.

In one aspect of the present disclosure, the "image forming apparatus" is an apparatus that forms and outputs an image, including a copying machine and a multifunction machine that have a copy function of a printer using an electrophotographic method for image formation with toner, an MFP (Multi-Functional Peripheral) that also includes functions other than copying, etc.

In Embodiment 1, a "reflective optical sensor" of one aspect of the present disclosure is realized by an image quality adjustment sensor 78. Furthermore, a "photoreceptor", a "charger", an "exposer", a "developer", a "transferer", and a "fuser" of one aspect of the present disclosure are realized by a photosensitive drum 202, a charging device 203, a laser writing unit 201, a developing device 204, a transfer device 205, and a fusing unit 208, respectively.

According to one aspect of the present disclosure, an image forming apparatus capable of reading a printing paper sheet size is realized by using in combination an existing reflective optical sensor for image density adjustment, without using a dedicated reading sensor.

Furthermore, a description will be made on preferred aspects of the present disclosure.

(2) In the image forming apparatus according to one aspect of the present disclosure, when the controller decides that an image size based on the image data does not correspond to the width in the main scanning direction of the recording medium decided based on the detection result of the reflective optical sensor, the controller may cause the image former to interrupt image formation.

In this way, it is possible to realize an image forming apparatus that interrupts printing when it is decided that the size of an image based on the image data does not corresponds to the width of the printing paper sheet based on the reflective optical sensor.

(3) The image forming apparatus according to one aspect of the present disclosure may further include an operator that receives size setting of the recording medium by a user, and when the controller decides that a size of the recording medium set by the user does not correspond to the width in the main scanning direction of the recording medium decided based on the detection result of the reflective optical sensor, the controller may cause the image former to interrupt image formation.

In this way, it is possible to realize an image forming apparatus that interrupts printing when it is decided that the size of the printing paper sheet set by the user does not corresponds to the width of the printing paper sheet based on the reflective optical sensor.

(4) The image forming apparatus according to one aspect of the present disclosure may further includes an informer that informs a user of a predetermined message, and when the controller decides that a size of the recording medium set by the user does not corresponds to the width in the main scanning direction of the recording medium decided based on the detection result of the reflective optical sensor, the controller may cause the informer to inform a message to prompt confirmation of a size of the recording medium.

In this way, it is possible to realize an image forming apparatus that informs a message to prompt confirmation of the size of the recording medium 31 to a user when it is decided that the size of the printing paper sheet set by the user does not corresponds to the width of the printing paper sheet based on the reflective optical sensor.

(5) In the image forming apparatus according to one aspect of the present disclosure, the operator may receive setting whether to make valid the detection of the size of the recording medium, and only when the setting of the size detection of the recording medium is valid, the controller may control the transporter and the reflective optical sensor during image forming, and decide whether the width in the main scanning direction of the recording medium is longer than a predetermined reference length.

In this way, it is possible to realize an image forming apparatus in which an existing reflective optical sensor for image density adjustment may read a printing paper sheet size only when detection of a printing paper sheet size is to be made valid.

DETAILED DESCRIPTION OF THE INVENTION

One aspect of the present disclosure will be described below in further detail using the accompanying drawings. The following description is illustrative in all respects and thus should not be construed as limiting the present disclosure.

Embodiment 1

Configuration of Digital Multifunction Machine 1

An outline of a digital multifunction machine 1 as an example of an image forming apparatus according to Embodiment 1 of the present disclosure will now be described with reference to FIG. 1 and FIG. 2.

Figure 1:
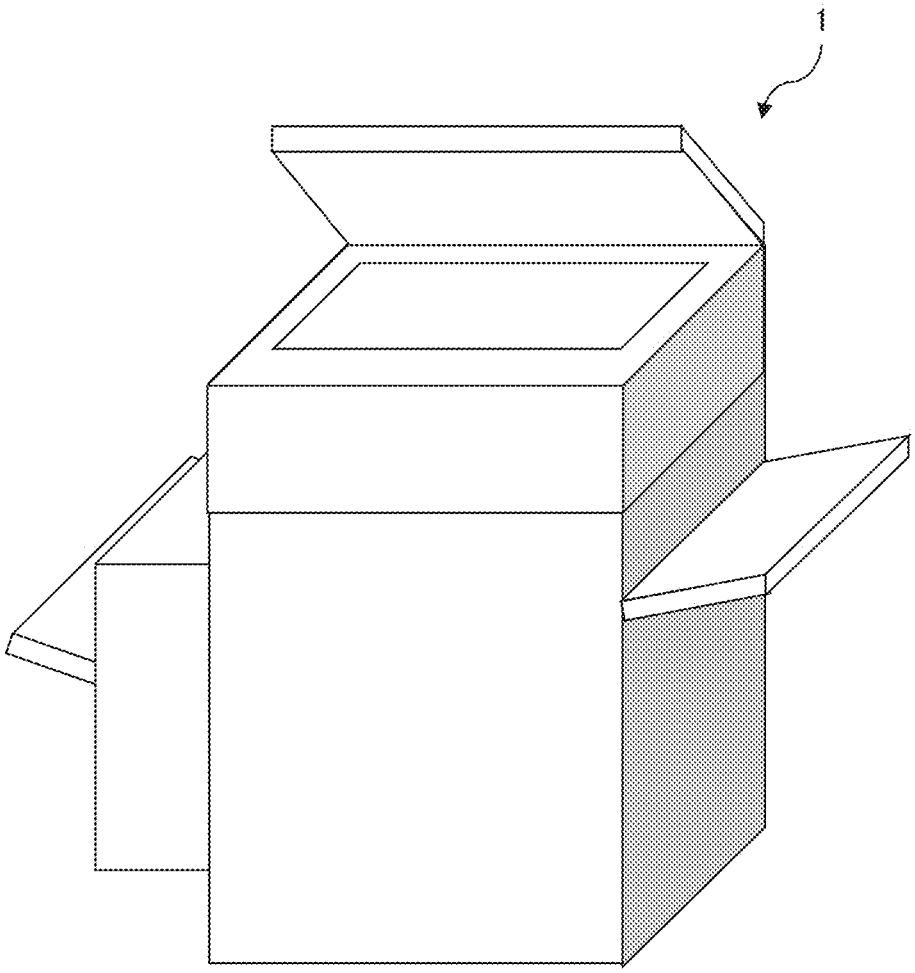
FIG. 1 is a perspective view illustrating an outer appearance of a digital multifunction machine having an image reading device of one aspect of the present disclosure.

FIG. 1 is a perspective view illustrating an outer appearance of the digital multifunction machine 1 according to Embodiment 1 of the present disclosure.

Figure 2:
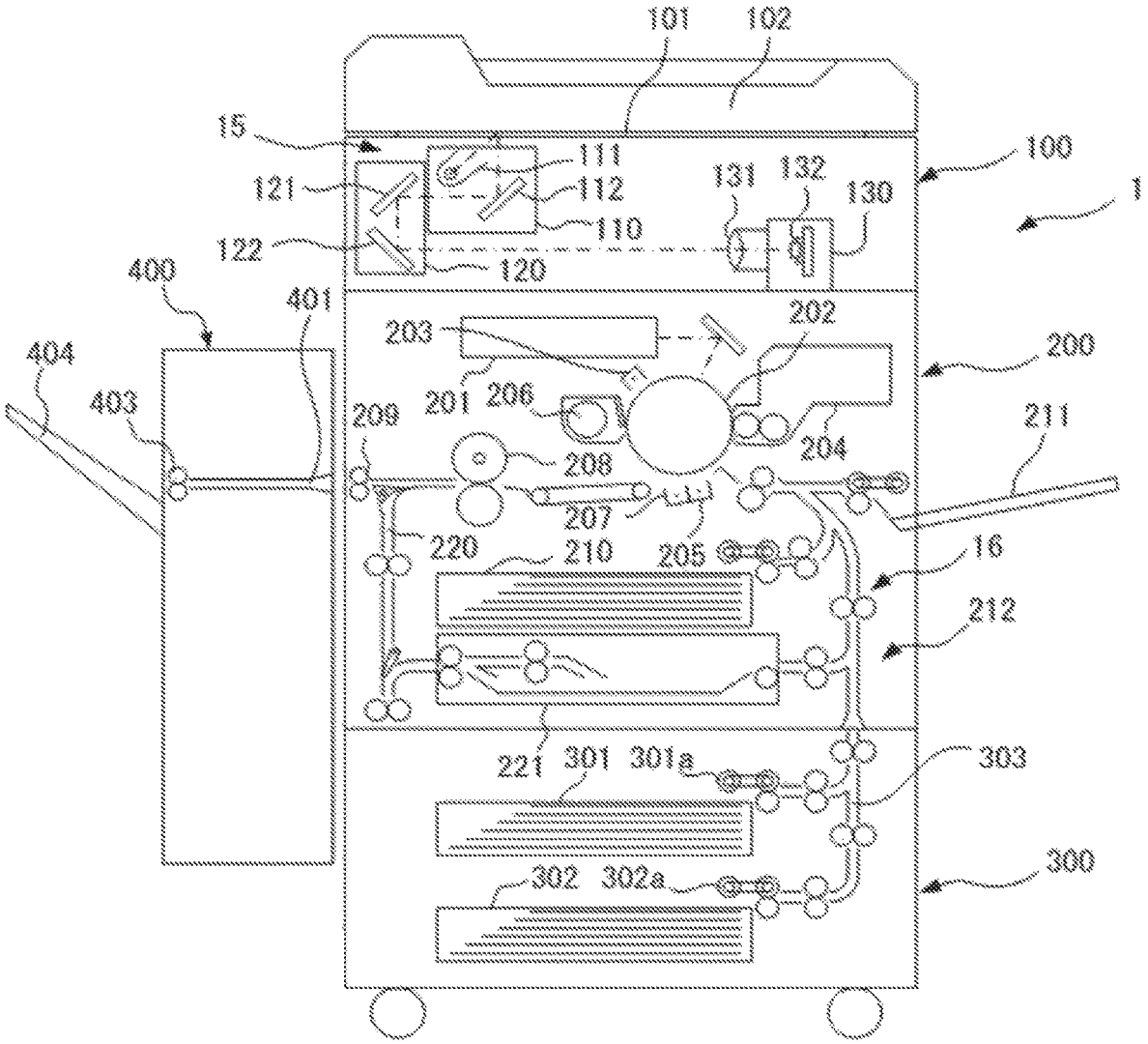
FIG. 2 is a sectional view illustrating an internal configuration of the digital multifunction machine of FIG. 1.

FIG. 2 is a sectional view illustrating the internal configuration of the digital multifunction machine 1 of FIG. 1.

The digital multifunction machine 1 is an apparatus that has a copy function, a scanner function, and a facsimile function, and that digitally processes image data read from a document and outputs the processed image data.

The digital multifunction machine 1 has a printing mode including copy, print, fax functions, and a controller 10 (FIG. 3) select a print function corresponding to reception of an operation input through a touch panel 17 (FIG. 3) or a print job from an external device such as a personal computer.

Internal Configuration of Digital Multifunction Machine 1

In FIG. 2, the digital multifunction machine 1 is a monochrome multifunction machine including an image reading unit 100 that reads an image from a document and generates image data, an image forming unit 200 that forms an image on a recording medium 31 based on the image data, a paper feed unit 300 that holds a recording mediums 31 to be supplied to the image forming unit 200, and a paper discharge unit 400 that discharges a recording medium 31 having the image formed by the image forming unit 200.

The image reading unit 100 includes an image reader 15 composed of a light source unit 110, a mirror unit 120, and a CCD reading unit 130 (CCD: Charge Coupled Device). The image reading unit 100 optically reads an image of a document placed on a document platen 101 of a platen glass or an image of a document conveyed onto the document platen 101 from an automatic document feeder 102 that separates and feeds documents one by one.

The light source unit 110 includes a light source 111 that irradiates the document with irradiation light for reading, and a mirror 112 that is disposed with its reflecting surface being tilted at 45° with respect to the surface of the document platen 101 in order to change, by 90°, a light path of the reflected light from the document.

Furthermore, the light source unit 110 is configured to move parallel to the surface of the document platen 101 by a stepping motor (not illustrated in the drawings), so as to scan the surface to be read of the document placed on the document platen 101.

The mirror unit 120 includes a pair of mirrors 121 and 122 arranged so that their reflecting surfaces are mutually orthogonal in order to further change, by 180°, the light path of the reflected light that has been changed by 90° by the mirror 112 of the light source unit 110.

The CCD reading unit 130 includes an imaging lens 131 and a CCD sensor 132, and focuses the reflected light from the document via the light source unit 110 and the mirror unit 120 on the CCD sensor 132 through the imaging lens 131.

The image formed on the CCD sensor 132 is taken as an analog electrical signal and converted to a digital signal by an AD converter (not illustrated in the drawings).

The converted digital signal is corrected for light distribution characteristics of the light source at the time of document reading, uneven sensitivity of the CCD sensor 132, etc. The resultant digital signal is once stored as image data in a digital form in an image memory (not illustrated in the drawings), and sent to the image forming unit 200.

The image forming unit 200 includes an image former 12 that is composed of the laser writing unit 201, the photosensitive drum 202, the charging device 203, the developing device 204, the transfer device 205, a cleaner 206, a static eliminator 207, etc. Based on image data generated by the image reading unit 100, image data obtained by developing a print job supplied from an external information processing apparatus (not illustrated), or image data obtained by decoding facsimile data supplied from an external facsimile device (not illustrated), the image forming unit 200 forms an image on a recording medium 31 fed from a paper feed cassette 210 included inside the image forming unit 200, a manual paper feed tray 211 disposed on its side surface, or the paper feed unit 300 disposed at a bottom part of the image forming unit 200.

The paper feed unit 300 includes paper sheet cassettes 301 and 302 that hold a large amount of recording mediums 31 of various sizes.

In response to an instruction from the image forming unit 200, the recording mediums 31 held in the paper sheet cassettes 301 and 302 are separated and picked up one by one by pickup rollers 301*a* and 302*a*, and conveyed to the image former 12 in the image forming unit 200 through paper sheet conveyance paths 303 and 212.

In the following, operation of the image forming unit 200 will be described. The aforementioned image data is sent to a storage 13 (see FIG. 3), and stored in a predetermined storage area in the storage 13.

The stored image data is sequentially read out on timing instructed by the controller 10 (see FIG. 3) and transmitted to the laser writing unit 201 which is an optical writing device.

The laser writing unit 201 is composed of a semiconductor laser source that emits a laser beam according to the image data transmitted from the storage 13, a polygon mirror that deflects the laser beam at a constant angular velocity and an f-θ lens that corrects the laser beam deflected at an equal angular velocity to be deflected at an equal angular velocity on the photosensitive drum 202, etc.

In Embodiment 1 of the present disclosure, the laser writing unit 201 is used as the optical writing device, but a fixed scanning type optical writing head unit using a light emitting element array of LEDs (Light Emitting Diode), ELs (Electro Luminescence), etc., may be used.

The photosensitive drum 202 is surrounded by: the charging device 203 that charges the photosensitive drum 202 to a predetermined potential; the developing device 204 that supplies toner to an electrostatic latent image formed on the photosensitive drum 202 to make the image visible; the transfer device 205 that transfer the toner image formed on a surface of the photosensitive drum 202 onto a recording medium 31 conveyed from the paper feed cassette 210, the manual paper feed tray 211, or the paper feed unit 300; the static eliminator 207 that eliminates the electric charge of the recording medium 31 on which the toner image has been transferred and separates the recording medium 31 from the photosensitive drum 202; and the cleaner 206 that collects the toner remaining after the toner image has been transferred.

The recording medium 31 on which the image has been transferred is conveyed to the fusing unit 208, and the image is fixed on the recording medium 31 by the fusing unit 208.

The recording medium 31 on which the image has been fixed is sent by a paper discharge roller 209 to the paper discharge unit 400.

Furthermore, the image forming unit 200 may also perform duplex printing by forming an image again on the back face of the recording medium 31 on which an image has been formed.

Therefore, the image forming unit 200 includes a switchback path 220 and a duplex unit 221 that invert the recording medium 31 on which the image has been formed and then convey the recording medium 31 to the image former 12.

The switchback path 220 is disposed on the upstream side of the paper discharge roller 209. In a case in which the recording medium 31 is inverted, an edge of the recording medium 31 is once grasped by the paper discharge roller 209 when the recording medium 31 is to be sent toward the paper discharge unit 400, and then the paper discharge roller 209 is rotated in reverse to convey the paper to the switchback path 220.

The recording medium 31 is then conveyed to the image former 12 through the duplex unit 221 and the paper sheet conveyance path 212, and an image is formed on the back face of the recording medium 31.

The switchback path 220 is used not only when image formation is performed on both faces of the recording medium 31, but also when the recording medium 31 is discharged with its image-formed-side facing downward.

The paper discharge unit 400 is disposed on a side part of the image forming unit 200. The paper discharge unit 400 includes a paper output tray 404, and discharges thereto the recording medium 31 on which an image has been formed by a print job.

When the image forming unit 200 forms an image in response to a print job, the recording medium 31 sent from the paper discharge roller 209 in the image forming unit 200 is then passed through a paper sheet conveyance path 401 and discharged onto the paper output tray 404 from a paper discharge roller 403 in the paper discharge unit 400.

Next, the schematic configuration of the digital multifunction machine 1 will be described with reference to FIG. 3.

Figure 3:
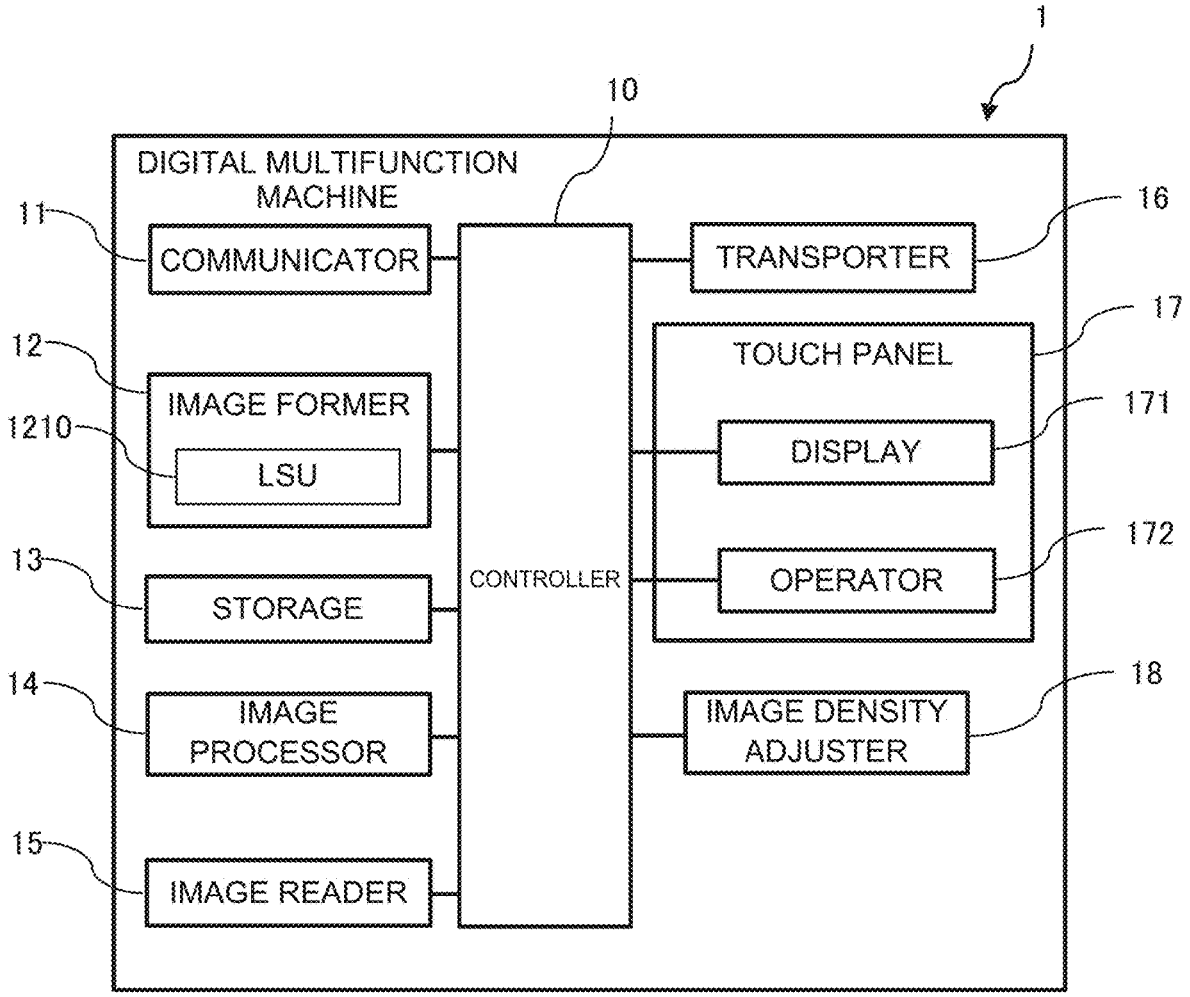
FIG. 3 is a block diagram illustrating a schematic configuration of the digital multifunction machine of FIG. 1.

FIG. 3 is a block diagram illustrating a schematic configuration of the digital multifunction machine 1 of FIG. 1.

As illustrated in FIG. 3, the digital multifunction machine 1 includes the controller 10, a communicator 11, the image former 12, the storage 13, an image processor 14, the image reader 15, a transporter 16, the touch panel 17, and an image density adjuster 18.

Hereinafter, each component of the digital multifunction machine 1 will be described.

The controller 10 controls the digital multifunction machine 1 in an integrated manner, and is composed of a CPU, a RAM, a ROM, various interface circuits, etc.

In order to control the operation of the digital multifunction machine 1 as a whole, the controller 10 detects each sensor, and monitors and controls all loads on a motor, a clutch, the touch panel 17, etc.

The communicator 11 is a section that communicates with a computer, a portable information terminal, an external information processing apparatus, a facsimile machine, etc., via a network or the like, and transmits and receives various kinds of information including mail and facsimile to and from such external communication devices.

The image former 12 is a section that prints out the image data generated by the image processor 14 on a recording medium 31. The image former 12 includes an LSU (Load/Store Unit) 1210.

The LSU 1210 is a device that irradiates a surface of the photosensitive drum 202 in an electrically charged state with a laser beam corresponding to image information represented by digital signals obtained by the image reader 15, thereby forming an electrostatic latent image.

The storage 13 is an element or a storage medium that stores information necessary for implementing various functions of the digital multifunction machine 1, a control program, etc. For example, the storage medium may be a semiconductor device such as a RAM, a ROM, etc., a hard disk; a flash storage; an SSD, or the like.

A program and data may be stored in different devices in such a way that an area for storing the data is a hard disk drive, and an area for storing the program is a flash storage.

The image processor 14 is a section that converts the image of the document read by the image reader 15 into an appropriate electrical signal so as to generate image data.

The image reader 15 is a section that detects and reads a document which is placed on a document platen or which is conveyed from a document tray or a sheet tray onto the document platen, and generates image data.

The transporter 16 conveys a recording medium 31 held at the manual paper feed tray 211, the paper feed cassette 210, the paper sheet cassettes 301 or 302, or the document platen 101, to the image former 12.

The touch panel 17 is a section that receives a command from a user through the touch panel function.

The touch panel 17 includes a display panel that is constituted of a liquid crystal panel, etc., and a touch panel disposed to overlay the display panel such as a capacitive touch panel that detects a position touched by a finger. The touch panel 17 thus includes a display 171 and an operator 172.

The display 171 is constituted of, for example, a CRT display, a liquid crystal display, an EL display, etc. The display 171 is a display device such as a monitor or a line display to display electronic data indicating such that an operating system or application software is in a processing state.

The controller 10 displays the operation and state of the digital multifunction machine 1 through the display 171.

The operator 172 is an interface for operating the digital multifunction machine 1, and is a section that receives a command from the user.

Figure 4:
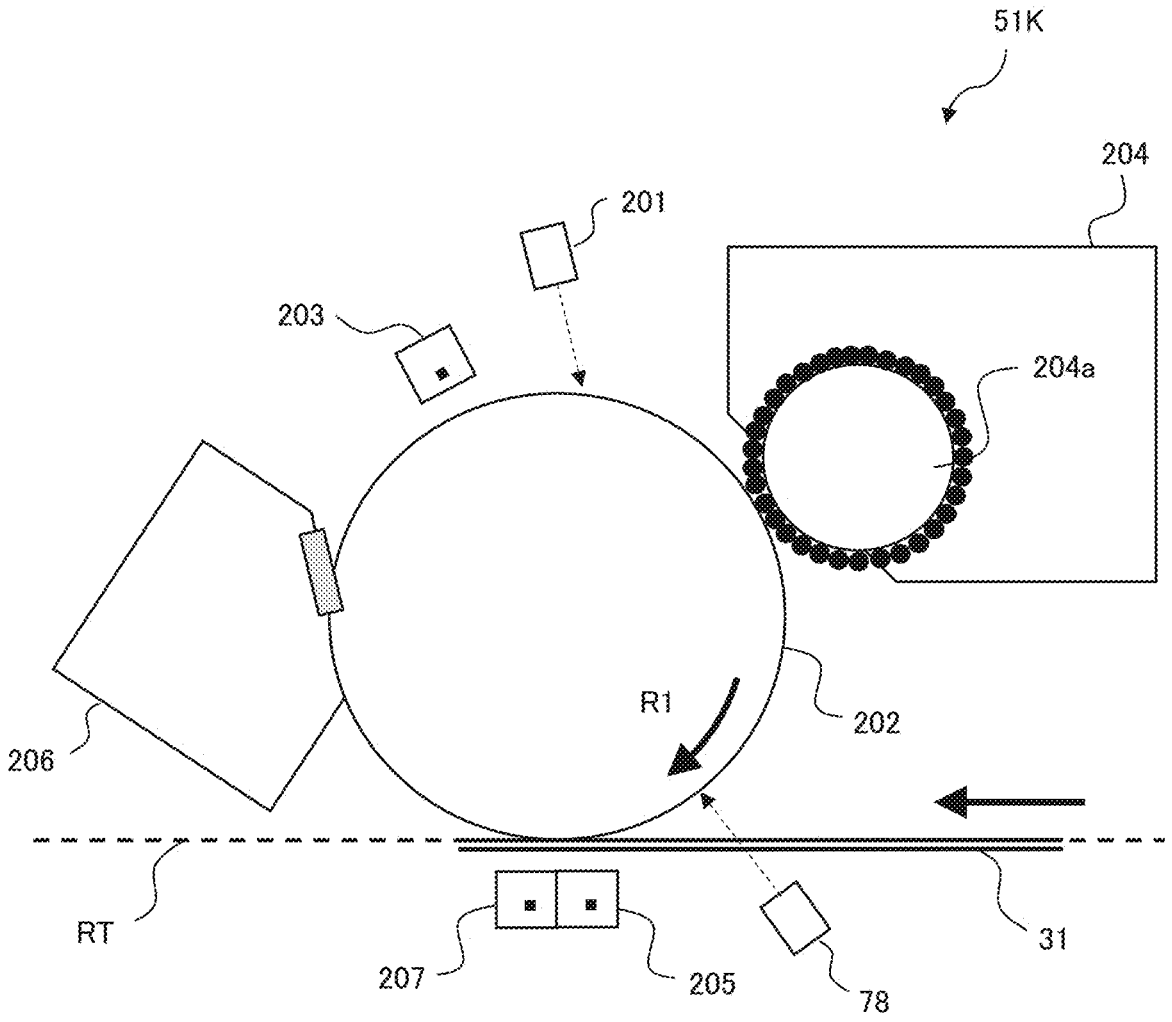
FIG. 4 is an explanatory diagram illustrating a schematic configuration of a visible image forming unit of the digital multifunction machine of FIG. 1.

The image density adjuster 18 is a section that adjusts image density based on the detection result of the image adjustment sensor 78 (see FIG. 4).

Size Detection Process for Recording Medium 31 in Digital Multifunction Machine 1

Next, a size detection process for the recording medium 31 in the digital multifunction machine 1 will be described with reference to FIG. 4 through FIG. 6.

FIG. 4 is an explanatory diagram illustrating a schematic configuration of a visible image forming unit 51K of the digital multifunction machine 1 of FIG. 1.

Figure 5A:
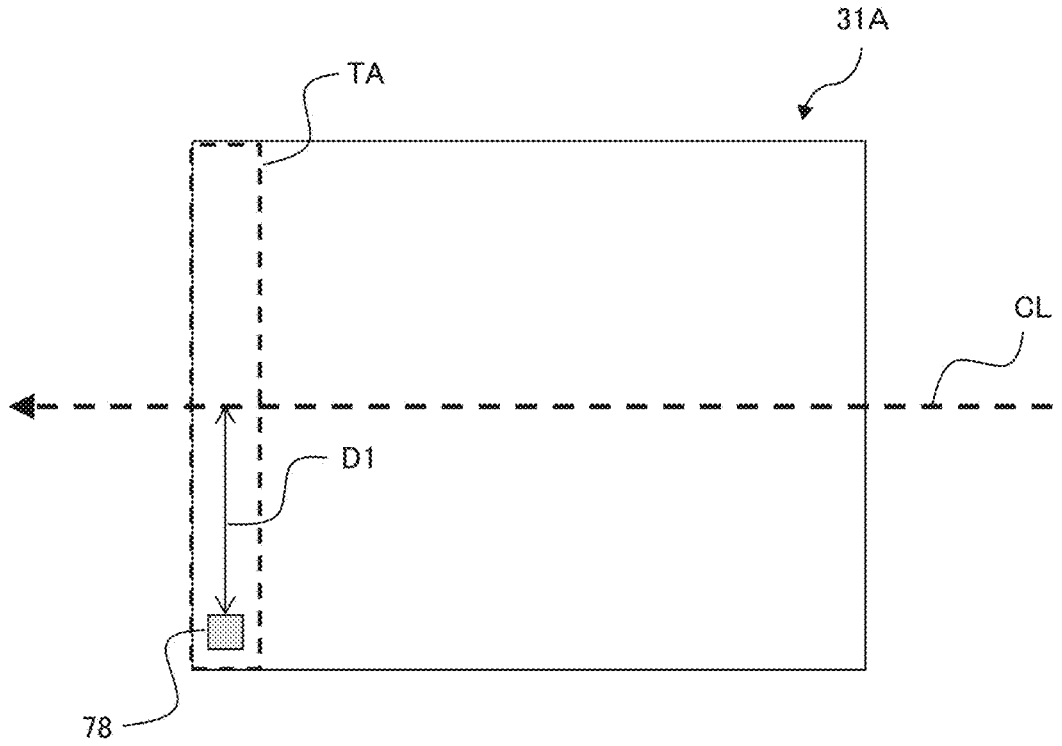
FIGS. 5A and 5B are an explanatory diagram illustrating one example of a recording medium size detection by the digital multifunction machine of FIG. 1.
Figure 5B:
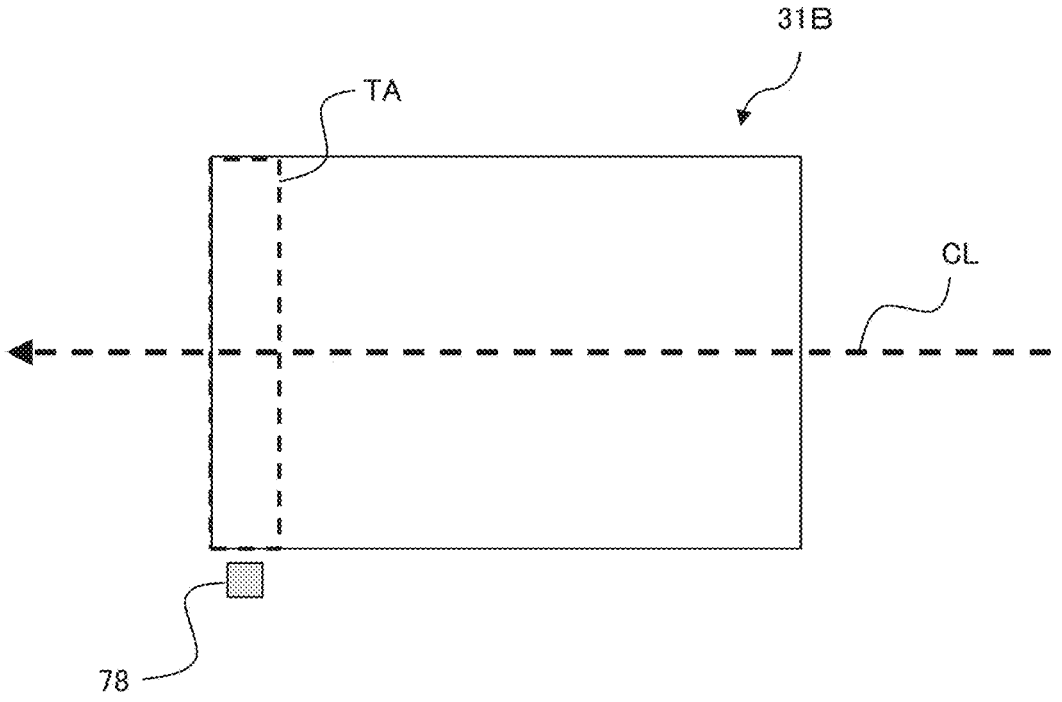

FIGS. 5A and 5B are an explanatory diagram illustrating one example of size detection for a recording medium 31 in the digital multifunction machine 1 of FIG. 1.

Figure 6:
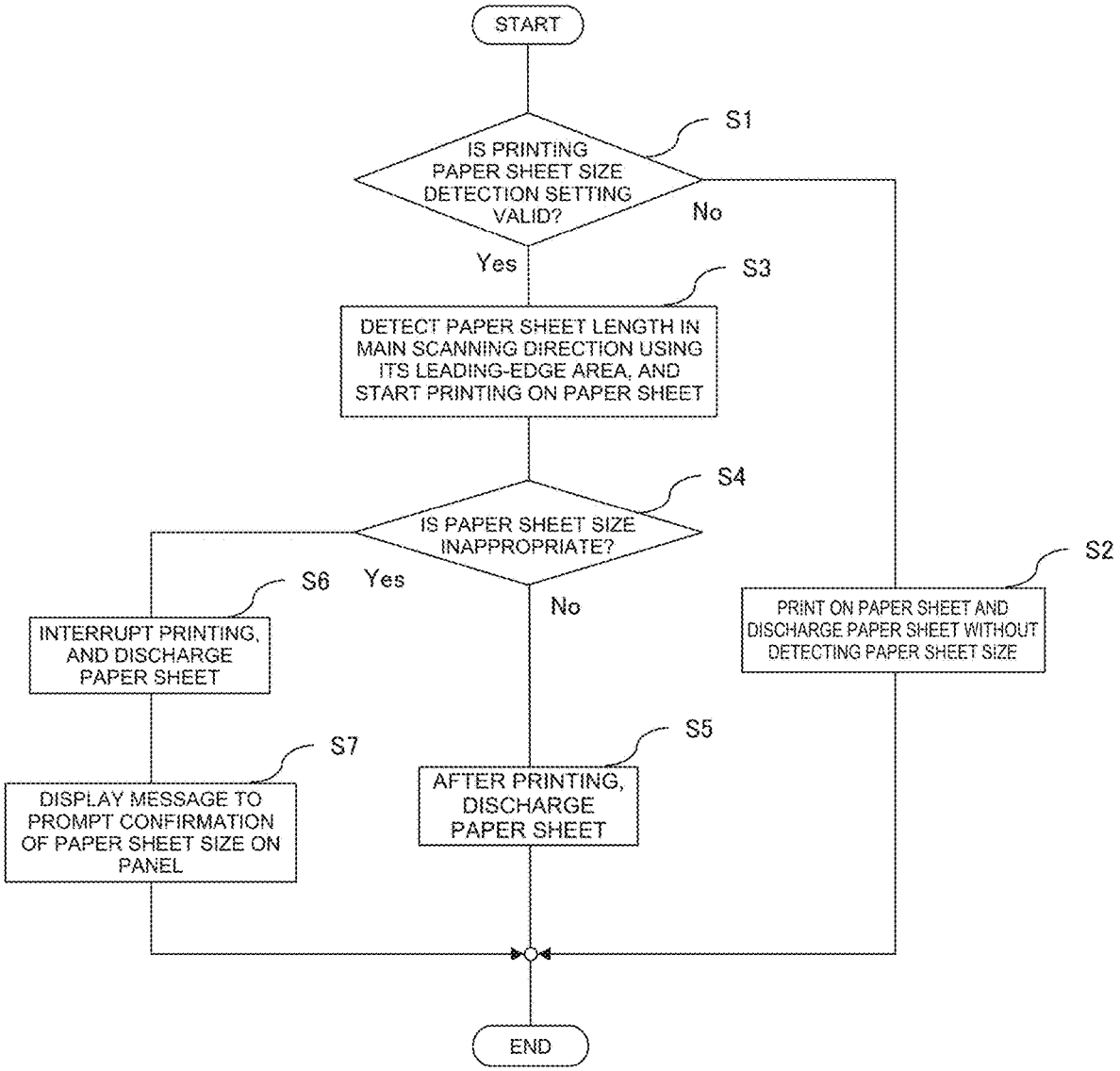
FIG. 6 is a flowchart illustrating one example of a size detection process for a recording medium in the digital multifunction machine of FIG. 1.

FIG. 6 is a flowchart illustrating one example of a size detection process of the recording medium 31 in the digital multifunction machine 1 of FIG. 1.

In FIG. 4, the photosensitive drum 202 rotates in a rotation direction R1 (the counterclockwise direction as viewed in the drawing).

During image formation, the surface of the photosensitive drum 202 is uniformly charged by the charging device 203.

The laser writing unit 201 exposes the surface of the charged photosensitive drum 202 to a beam from the laser source so that an electrostatic latent image is formed on the surface of the photosensitive drum 202.

The laser beam from the laser writing unit 201 is irradiated to the photosensitive drum 202 through a polygon mirror and various lenses (not illustrated).

The laser writing unit 201 is controlled based on the image information, and an electrostatic latent image corresponding to the image information is formed on the surface of the photosensitive drum 202.

The developing device 204 develops an electrostatic latent image on the photosensitive drum 202 to form a toner image.

The electrostatic latent image formed on the photosensitive drum 202 is visualized by the developing device 204 with a developing agent that contains toner and carrier, whereby a toner image is formed.

As illustrated in FIG. 4, the developing device 204, which is a unit for developing, is disposed facing the photosensitive drum 202. A developing roller 204*a* serving as a developing agent carrier is disposed so as to be rotatable around a rotation axis that is parallel to the rotation axis of the photosensitive drum 202.

The developing device 204 is a hollow container-like member made of, for example, a hard synthetic resin. The developing device 204 holds therein a two-component developing agent that contains toner and carrier as described above. Alternatively, the developing agent may be a one-component developing agent that contains only toner.

The developing roller 204*a* is a magnet roller formed by circumferentially disposing magnet members in such a manner that polarities of the adjacent magnet members are substantially different from each other.

The developing roller 204*a* adsorbs the developing agent held in the developing device 204 by its magnetic force.

The adsorbed developing agent is regulated by a developing agent regulating member (not illustrated) to have a predetermined thickness, and is conveyed to a developing nip at which the developing roller 204*a* and the photosensitive drum 202 are in close proximity.

Applied with a developing voltage, the developing roller 204*a* is charged to a predetermined voltage that is lower than the surface electric potential of the non-exposed portion of the photosensitive drum 202.

As a result, the toner charged with the same polarity as that of the photosensitive drum 202 is electrostatically attracted to the surface electric potential at the exposed portion of the photosensitive drum 202.

On the other hand, the surface electric potential at the non-exposed portion of the photosensitive drum 202 is lower than the electric potential of the developing roller 204*a*.

The transfer device 205 has been applied with a voltage of polarity which is opposite to that of the toner. The toner image developed on the photosensitive drum 202 is transferred onto the recording medium 31 at a transfer zone at which the transfer device 205 and the photosensitive drum 202 are in close proximity.

Then, the recording medium 31 carrying thereon the toner image is conveyed to the fusing unit 208 and is sufficiently heated by a fusing roller and a pressure roller therein, so that the unfixed toner image is fused and fixed to the recording medium 31. The recording medium 31 on which the toner image is fixed is passed through the paper sheet conveyance path 401 and is discharged from the paper discharge roller 403 to the paper output tray 404.

In a case of duplex printing, after the recording medium 31 is passed through the fusing unit 208 so as to complete image forming on the front face of the recording medium 31, the recording medium 31 is then inverted through the switchback path 220, and an image is formed on the back face of the recording medium 31.

The image quality adjustment sensor 78 is a reflective optical sensor that impinges light on a test patch formed on the photosensitive drum 202 and reads the image density of the patch from the reflected light.

As illustrated in FIG. 5A, the image quality adjustment sensor 78 is provided at a position away from a center line CL extending in the main scanning direction on the paper sheet conveyance path RT by a predetermined distance D1 in the main scanning direction.

When detecting the size of the recording medium 31, the image quality adjustment sensor 78 detects reflected light from a predetermined leading edge area TA of a recording medium 31A.

This is because it is necessary to perform the detection on timing that toner is not formed on the photosensitive drum 202 because false recognition may occur if toner has been formed on the photosensitive drum 202.

Not limited to the leading edge area TA of the recording medium 31A, the reflected light from a predetermined trailing edge area RA of the recording medium 31A may be detected.

In FIG. 5A, the recording medium 31A block the light from the image quality adjustment sensor 78.

On the other hand, in FIG. 5B, a recording medium 31B does not block the light from the image quality adjustment sensor 78, and the reflected light from the photosensitive drum 202 is detected.

Thus, the image quality adjustment sensor 78 becomes possible to decide whether the size of the recording medium 31 is larger than a predetermined standard size.

Next, the size detection process for the recording medium 31 in the digital multifunction machine 1 will be described.

In FIG. 6, after printing is started, the controller 10 decides at step S1 whether the printing paper sheet size detection setting is valid (step S1).

If the printing paper sheet size detection setting is not valid (i.e., when the decision at step S1 is NO), the controller 10 prints and discharges the recording medium 31 at step S2 without detecting the size of the recording medium 31 as usual (step S2).

Then the controller 10 terminates the print process.

On the other hand, if the printing paper sheet size detection setting is valid (i.e., when the decision at step S1 is YES), the controller 10 causes the transporter 16 to start transporting the recording medium 31, and causes the image quality adjustment sensor 78 to detect the length in the main scanning direction using the leading edge area TA of the recording medium 31 at step S3. The controller 10 also causes the image former 12 to start image forming on the recording medium 31 (step S3).

Subsequently, the controller 10 decides at step S4 whether the size of the recording medium 31 is inappropriate based on the detection result by the image quality adjustment sensor 78 (step S4).

If the size of the recording medium 31 is appropriate (i.e., when the decision of step S4 is NO), the controller 10, at step S5, causes the image former 12 to form an image on the recording medium 31 and then discharges the recording medium 31 to the paper output tray 404 (step S5).

Thereafter, the controller 10 terminates the printing process.

On the other hand, if the size of the recording medium 31 is appropriate (i.e., when the decision at step S4 is YES), the controller 10 at step S6 causes the image former 12 to interrupt image forming on the recording medium 31 and to discharge the recording medium 31 to the paper output tray 404 (step S6).

At a subsequent step S7, the controller 10 causes the display 171 to display a message to prompt confirmation of the size of the recording medium 31 to a user (step S7).

Thereafter, the controller 10 terminates the printing process.

In this way, the digital multifunction machine 1 capable of reading the size of the recording medium 31 may be realized using an existing image quality adjustment sensor 78 without the use of the dedicated reading sensor.

Embodiment 2

Size Detection Process for Recording Medium 31 in Digital Multifunction Machine 1 According to Embodiment 2 of Present Disclosure Next, a size detection process for the recording medium 31 in the digital multifunction machine 1 according to Embodiment 2 of the present disclosure will be described with reference to FIG. 7.

Since the configuration of the digital multifunction machine 1 of Embodiment 2 is the same as that of the digital multifunction machine 1 of Embodiment 1 (FIG. 1 to FIG. 4), the description is omitted.

Figure 7:
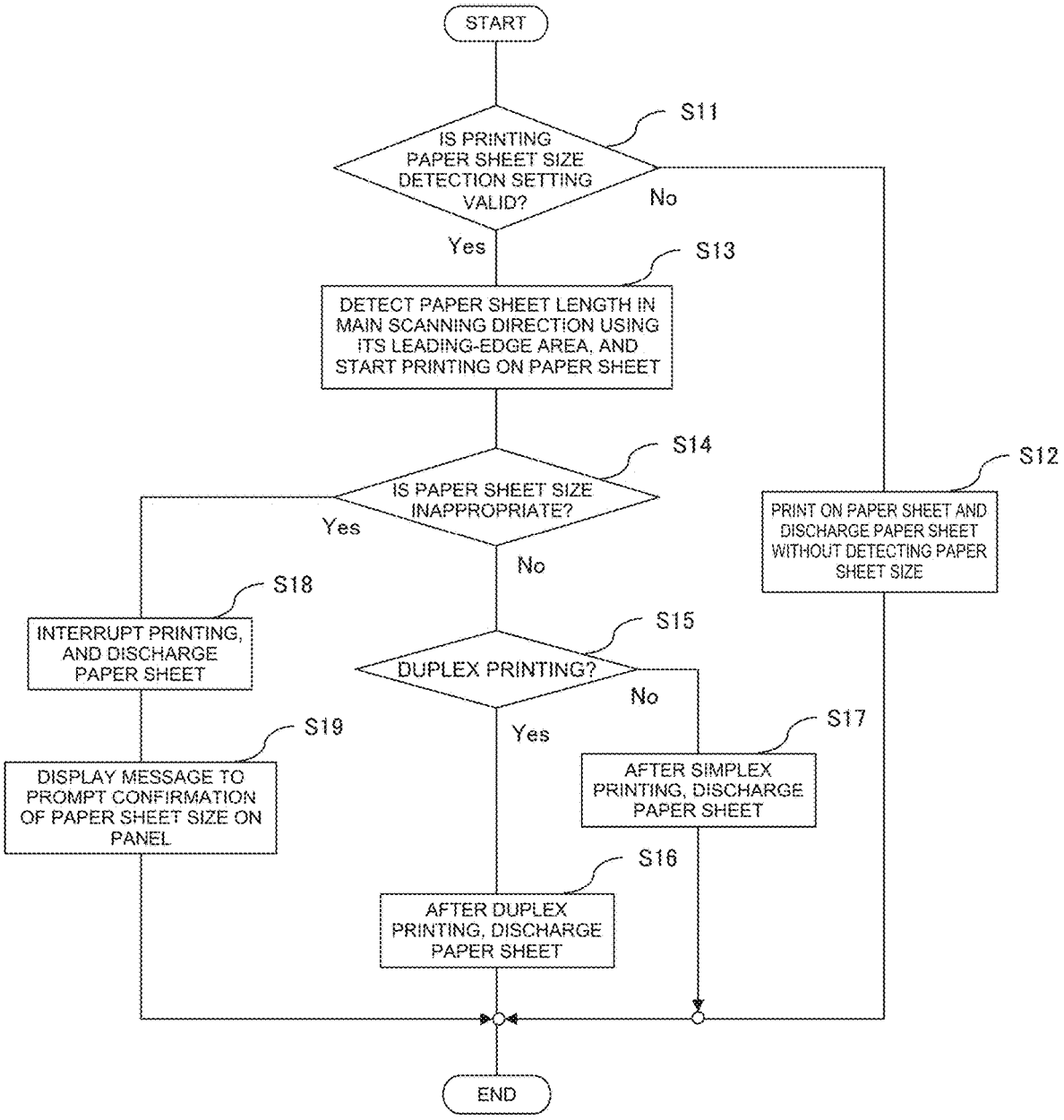
FIG. 7 is a flowchart illustrating one example of a size detection process for the recording medium in the digital multifunction machine according to Embodiment 2 of the present disclosure.

FIG. 7 is a flowchart illustrating one example of a size detection process for the recording medium 31 in the digital multifunction machine 1 according to Embodiment 2 of the present disclosure.

Since the processes of steps S11 through S14, S18, and S19 in FIG. 7 respectively correspond to the processes of steps S1 through S4, S6, and S7 in FIG. 6, description thereof will be omitted.

In the following, description will be made on the processes of steps S15 through S17 in FIG. 7 which are not described in Embodiment 1.

If the paper sheet size is appropriate under the decision at step S14 in FIG. 7 (i.e. when the decision at step S14 is NO), the controller 10 decides at step 15 whether the print setting is duplex printing (step S15).

If the print setting is set to duplex printing (i.e. when the decision at step 15 is YES), the controller 10, at step 16, causes the image former 12 to form an image on both sides of the recording medium 31, and then discharges the recording medium 31 to the paper output tray 404 (step S16). Thereafter, the controller 10 terminates the printing process.

On the other hand, if the printing setting is set to simplex printing (i.e., when the decision at step S15 is NO), the controller 10, at step S17, causes the image former 12 to form an image on a single side of the recording medium 31, and then discharges the recording medium 31 to the paper output tray 404 (step S17).

Thereafter, the controller 10 terminates the printing process.

In this way, even when either simplex printing or duplex printing is selectable, the digital multifunction machine 1 capable of reading the size of the recording medium 31 may be realized using the existing image quality adjustment sensor 78 without the use of the dedicated reading sensor.

While there have been described what are at present considered to be certain embodiments of the invention, it will be understood that various modifications may be made thereto, and it is intended that the appended claims cover all such modifications as fall within the true spirit and scope of the invention.

What is claimed is:

1. An image forming apparatus comprising:

a transporter that transports a recording medium through a conveyance path;

an image former that forms an image on the recording medium based on image data;

a reflective optical sensor for image density adjustment;

a circuit configured to adjust image density based on detection result of the reflective optical sensor; and a controller, wherein the image former includes:

a photoreceptor;

a charger that charges the photoreceptor in contact with the photoreceptor;

an exposer that forms an electrostatic latent image on the photoreceptor;

a developer that supplies toner to the photoreceptor to form a toner image corresponding to the electrostatic latent image;

a transferer that transfers the toner image to the recording medium; and a fuser that heat-fixes the toner image on the recording medium by a fusing roller, the reflective optical sensor is fixedly provided opposite to the photoreceptor across the conveyance path so as to irradiate with light a position away from a center line of the paper sheet conveyance path by a predetermined distance in a main scanning direction, and the recording medium blocks light from the reflective optical sensor only when a width in the main scanning direction of the recording medium is longer than a predetermined reference length, during image density adjustment, the controller controls the charger, the exposer, and the developer to form a predetermined patch toner image on the photoreceptor, controls the reflective optical sensor to irradiate the patch toner image with light, and control the circuit configured to adjust image density based on reflected light from the patch toner image, during image forming, the controller controls the transporter and the reflective optical sensor to cause the reflective optical sensor to emit light on timing that a predetermined leading edge area of the recording area passes, and decides based on reflected light therefrom whether the width in the main scanning direction of the recording medium is longer than the predetermined reference length.

2. The image forming apparatus according to claim 1, wherein when the controller decides that an image size based on the image data does not correspond to the width in the main scanning direction of the recording medium decided based on the detection result of the reflective optical sensor, the controller causes the image former to interrupt image formation.

3. The image forming apparatus according to claim 2, further comprising an informer that informs a user of a predetermined message, wherein when the controller decides that a size of the recording medium set by the user does not corresponds to the width in the main scanning direction of the recording medium decided based on the detection result of the reflective optical sensor, the controller causes the informer to inform a message to prompt confirmation of a size of the recording medium.

4. The image forming apparatus according to claim 1, further comprising an interface that receives size setting of the recording medium by a user, wherein when the controller decides that a size of the recording medium set by the user does not correspond to the width in the main scanning direction of the recording medium decided based on the detection result of the reflective optical sensor, the controller causes the image former to interrupt image formation.

5. The image forming apparatus according to claim 4, wherein the interface receives setting whether to make valid detection of the size the recording medium, and only when the setting of the detection of the size of the recording medium is valid, the transporter and the reflective optical sensor are controlled, during image forming, to decide whether the width in the main scanning direction of the recording medium is longer than the predetermined reference length.

* * * * *